US006339846B2

(12) United States Patent
Uchida

(10) Patent No.: US 6,339,846 B2
(45) Date of Patent: Jan. 22, 2002

(54) POCKET FOR PORTABLE TELEPHONE IN CLOTHES

(75) Inventor: Shizumaru Uchida, Hiroshima-ken (JP)

(73) Assignee: Big Born Shoji Co., Ltd., Hiroshima (JP)

( * ) Notice: Subject to any disclaimer, the term of this patent is extended or adjusted under 35 U.S.C. 154(b) by 0 days.

(21) Appl. No.: 09/917,622

(22) Filed: Jul. 31, 2001

Related U.S. Application Data

(62) Division of application No. 09/400,439, filed on Sep. 21, 1999.

(30) Foreign Application Priority Data

Nov. 5, 1998 (JP) ..... 10-08718
Nov. 9, 1998 (JP) ..... 10-08818
Mar. 12, 1999 (JP) ..... 11-01464

(51) Int. Cl.[7] ..... A41D 27/20
(52) U.S. Cl. ..... 2/247; 2/250; 2/94; 2/227
(58) Field of Search ..... 2/247, 249, 250, 2/253, 254, 108, 94, 51, 102, 248, 227, 115, 243.1, 69, 48; 224/191, 222, 660, 676, 681, 230, 930

(56) References Cited

U.S. PATENT DOCUMENTS 779,898 A 1/1905 Yates
815,063 A 3/1906 Brigham
1,036,859 A 8/1912 Kirshen
1,879,341 A 9/1932 Lapham
2,538,677 A 1/1951 Ferrand
4,637,075 A 1/1987 Ingrisano et al.
5,398,345 A 3/1995 Kenneth et al.
5,517,696 A 5/1996 Krugler
5,957,357 A 9/1999 Kallman
6,109,496 A 8/2000 Andrew et al.
6,209,769 B1 4/2001 Seals et al.
6,216,280 B1 4/2001 Rabe
6,237,152 B1 * 5/2001 Gootrad ..... 2/87

* cited by examiner

*Primary Examiner*—Amy B. Vanatta
(74) *Attorney, Agent, or Firm*—Venable; John P. Shannon; Chad C. Anderson

(57) ABSTRACT

This invention relates to a pocket for portable telephone in clothes. The pocket is provided in cloth such as front body cloth or sleeve cloth in a jacket, and front body cloth or back body cloth in slacks. The pocket comprises a lower section provided horizontally in cloth with the width of 6 cm~11 cm, and an upper section provided horizontally to the lower section with the same width thereof. A bottom bag made of stretchy cloth with the comparatively shallow depth is sewed to the lower section to be suspended behind the cloth. A head bag with the height of 2 cm~4 cm is sewed to the upper section to oppose upward to the bottom bag. The number of the upper section is not limited to one, but the upper section with the width of 2 cm~3 cm can be provided above both sides of the lower section.

15 Claims, 8 Drawing Sheets

POCKET FOR PORTABLE TELEPHONE IN CLOTHES

This application is a divisional of application Ser. No. 09/400,439 filed Sep. 21, 1999.

FIELD OF THE INVENTION

The present invention relates to a pocket in clothes such as a jacket and slacks, or more precisely, a pocket for portable telephone in clothes which can contain a portable telephone.

BACKGROUND OF THE INVENTION

As a portable telephone has been miniaturized and lightened, it has been widely spread and easily carried away lately. It is carried away mainly in a pocket fixed at a jacket and slacks.

When carrying a portable telephone in a pocket of slacks, of especially a side pocket thereof, it is difficult to take out only the portable telephone from the pocket, since in many cases there are also other small articles such as cigarettes and a lighter. Besides, it is difficult to take out it from a rear pocket of slacks, especially while sitting, since the rear pocket is comparatively small, and obstructed by bulky loins.

Moreover, when being carried in the pocket of slacks, the portable telephone may suddenly jump out or fall off the pocket due to one's physical motions such as walking, standing, and sitting.

Furthermore, when being carried in a pocket of a jacket, it may also fall off the pocket on the occasion of taking off or putting on the jacket.

The Japanese Utility Model No. 3019172 discloses a special pocket for portable telephone fixed at both sides of clothes. Besides, the Japanese Utility Model No. 3025210 discloses a pocket for portable telephone fixed inside a conventional pocket.

However, these pockets can not prevent the portable telephone from suddenly falling off, and one needs to pay special attention when standing and sitting.

Therefore, an object of this invention is to improve a pocket for portable telephone in clothes such as a jacket and slacks.

SUMMARY OF THE INVENTION AND ADVANTAGES

The present invention is characterized by a pocket for portable telephone in clothes comprising a lower section provided horizontally in cloth with the width of 6 cm~9 cm, a bottom bag made of stretchy cloth with the comparatively shallow depth of 6 cm~11 cm, which is sewed to the lower section to be suspended behind the cloth, an upper section provided horizontally 2 cm~4 cm above the lower section with the same width thereof, and a head bag sewed to the upper section to stay upward behind the cloth with the height of 2 cm~4 cm. Because of this structure, about one third to a quarter of the portable telephone is always sticked out of the bottom bag, and some of the sticked out part is inserted into the head bag. Accordingly, an upper part of the portable telephone is stably caught in the head bag, thereby causing no former troubles such as jumping out and falling off. Besides, because the bottom bag made of stretchy cloth is effectively stretched, the portable telephone can be easily inserted and stably caught in the pocket.

The present invention is further characterized by a pocket for portable telephone in clothes comprising a lower section provided horizontally in cloth with the width of 6 cm~9 cm, a bottom bag made of stretchy cloth with the comparatively shallow depth of 5 cm~10 cm, which is sewed to the lower section to be suspended behind the cloth, at least one upper section provided 2 cm~4 cm above the right or left end of the lower section with the width of 2 cm~3 cm, and an antenna covering bag sewed to the upper section to stay upward behind the cloth with the height of 1 cm~3 cm. Because an antenna of the portable telephone is caught in the antenna covering bag, the portable telephone does not easily fall off regardless of one's physical motions such as standing and sitting. Besides, the antenna can be easily taken out of the antenna covering bag by only pushing an exposed upper part of the portable telephone downward a little, thereby effecting its easy use.

Moreover, in the present invention, an upper section with the width of 2 cm~3 cm is provided to have a fixed inclination against the lower section. With this structure, the antenna of the portable telephone can be speedily inserted or taken out.

The above pocket for portable telephone is provided in cloth such as front body cloth or sleeve cloth in a jacket, and front body cloth or back body cloth in slacks. Accordingly, one can easily carry and use the portable telephone by wearing these clothes.

BRIEF DESCRIPTION OF THE DRAWINGS

FIG. 1 shows the first preferred embodiment of this invention.

FIG. 8 shows the second preferred embodiment of this invention.

DESCRIPTION OF PREFERRED EMBODIMENTS

Figure 1A:
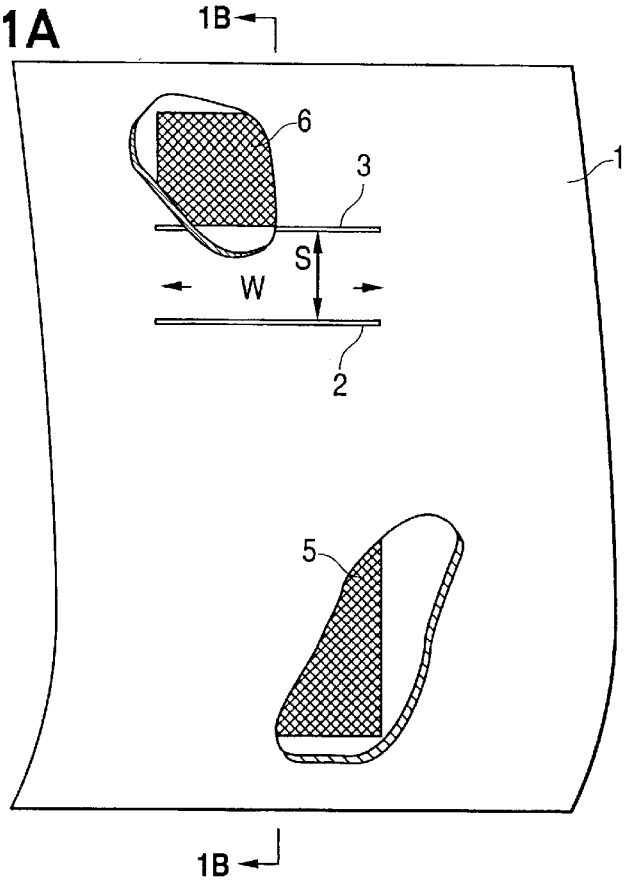
FIG. 1A is a partially cutaway front view.
Figure 1B:
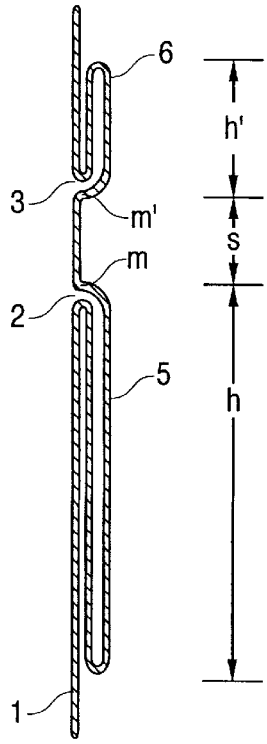
FIG. 1B is a sectional view taken along the line X—X of FIG. 1A.

Now a detail explanation of this invention follows with attached drawings. FIG.1 shows the first embodiment of this invention; FIG. 1A is a partially cutaway front view, and FIG. 1B is a sectional view taken along the line X—X of FIG. 1A. As shown in these figures, a pocket for portable telephone is formed in cloth 1, comprising a lower section 2 and an upper section 3.

The lower section 2 is formed horizontally in cloth 1. The width "w" thereof is usually within 6 cm~9 cm, though it can be suitably changed according to the size of a portable telephone 4.

A bottom bag 5 is sewed (m) to the lower section 2 so as to be suspended behind the cloth 1. The bottom bag 5 is made of different cloth of stretchy material in advance to form a cylindrical bag with the depth (h). Though the depth (h) can be also suitably changed according to the size of the portable telephone 4, it is usually within 6 cm~11 cm. Accordingly, the bottom bag 5 is comparatively shallow in depth. This is because not the whole of the portable telephone 4 is inserted in the bottom bag 5, but about one third to a quarter of an upper part thereof is always sticked out.

On the other hand, the upper section 3 is horizontally formed above the lower section 2 with the same width thereof in cloth 1.

A head bag 6 is sewed (m') to the upper section 3 so as to oppose to the bottom bag 5 behind cloth 1 with the bottom of the head bag 6 upward. The head bag 6 is made of different cloth in advance to form a cylindrical bag with the height (h'). The height (h') is usually within 2 cm~4 cm. An exposed upper part 4*a* of the portable telephone 4 is caught and inserted in the head bag 6.

Here, an interval (s) between the lower section 2 and the upper section 3, both provided horizontally, can be suitably changed. However, according to experiments of this inventor, it is suitable to be within 2 cm~4 cm for an easy insertion of the portable telephone 4.

In this invention, at least the upper part 4*a* of the portable telephone 4 is caught in the head bag 6, when the portable telephone 4 is inserted into the bottom bag 5, thereby causing no former troubles such as jumping out and falling off of the portable telephone.

Besides, since in this invention the bottom bag 5 is made of stretchy material, the portable telephone can be easily inserted due to a stretchy effect of the bottom bag 5. Moreover, the portable telephone 4 is suitably pushed upward due to repulsion, when being pressed downward in the bottom bag 5. Therefore, the exposed upper part can be easily caught in the head bag 6.

Figure 2:
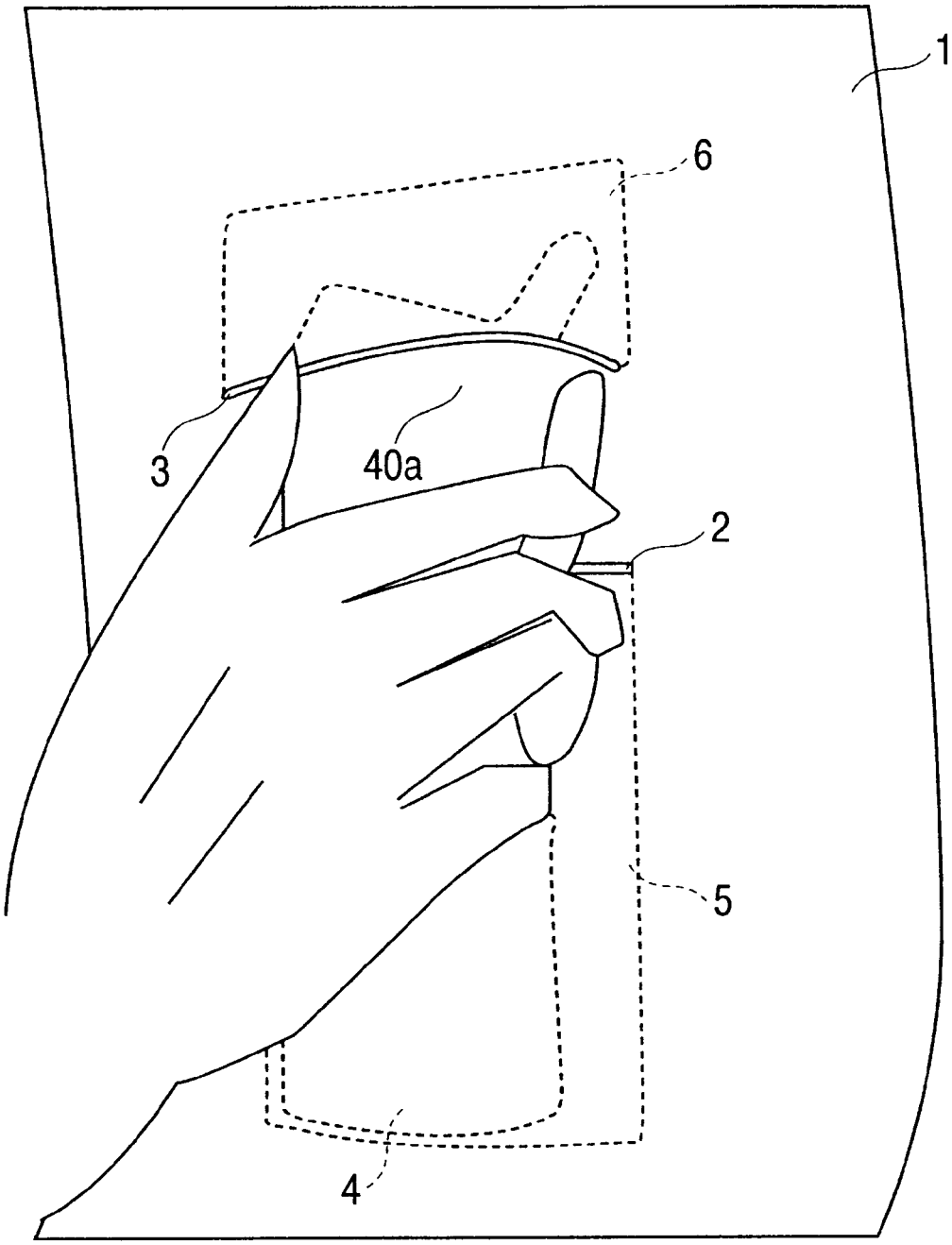
FIG. 2 shows how to use a pocket disclosed in FIG. 1.

FIG. 2 shows how to use the pocket for portable telephone.

In this invention, the, cloth in which the above pocket for portable telephone is formed is cloth for a jacket and slacks. More concretely, the pocket for portable telephone is formed in jacket cloth at the chest or upper arm, and in slacks cloth below both sides pockets or at loins. The jacket is not limited to one, but any kind of jackets with long or short sleeves, which are worn in daily life, such as a working wear, shirt, or blouson.

Figure 3:
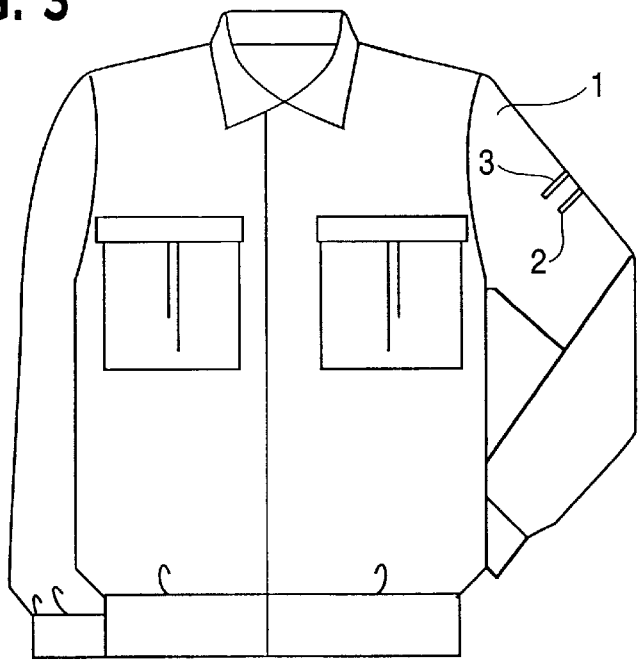
FIG. 3~FIG. 7 show working examples of the pocket disclosed in FIG. 1.

FIG. 3 shows a pocket for portable telephone fixed at an upper arm on sleeve cloth of a jacket.

Figure 4:
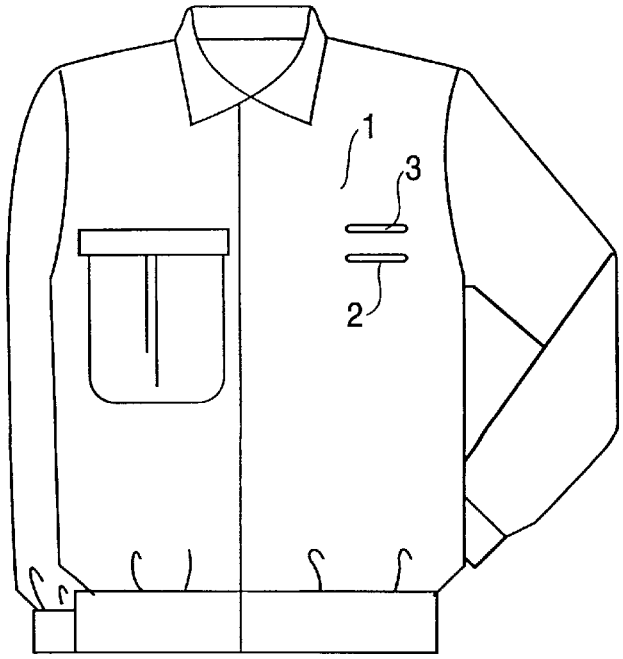

FIG. 4 shows a pocket for portable telephone fixed at the chest on front body cloth of a jacket.

Figure 5:
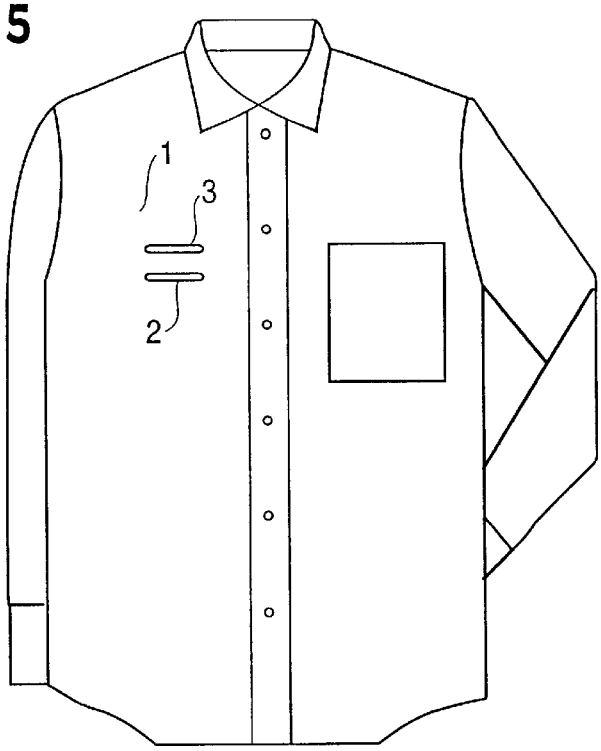

FIG. 5 shows a pocket for portable telephone fixed at the chest on front body cloth of a shirt.

Figure 6:
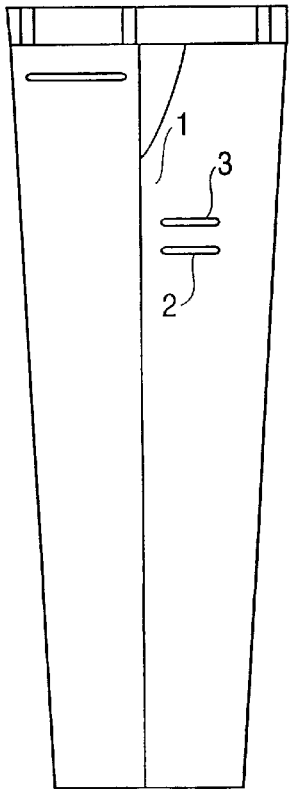

FIG. 6 shows a pocket for portable telephone fixed below a side pocket on front body cloth of slacks.

Figure 7:
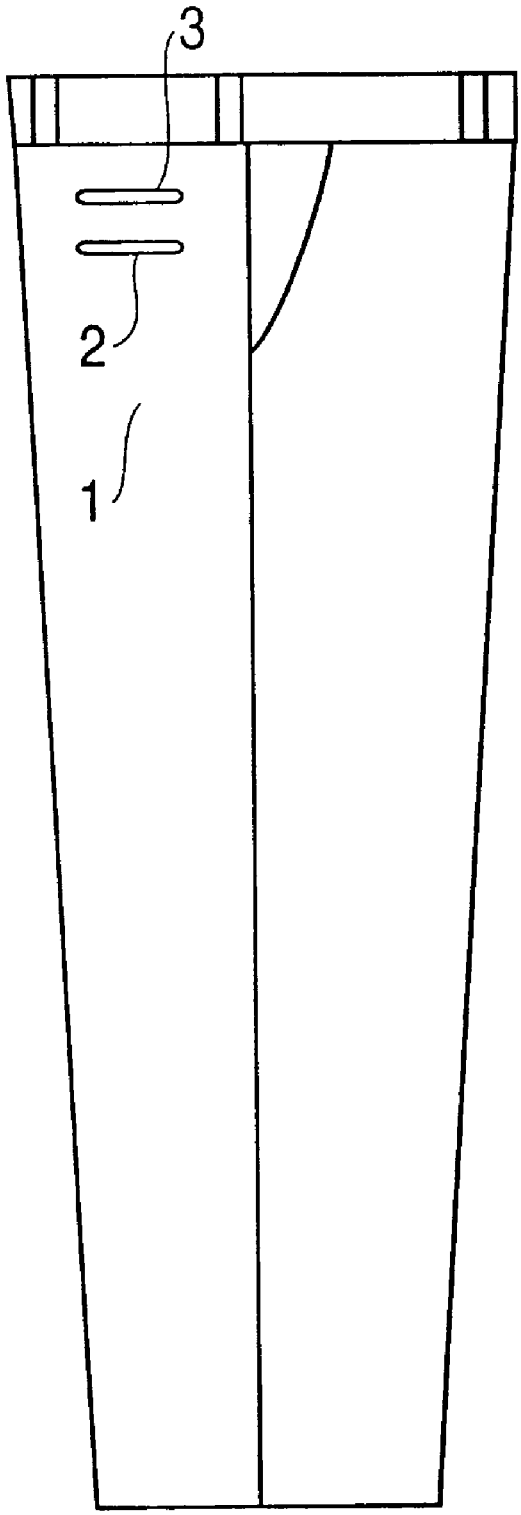

FIG. 7 shows a pocket for portable telephone fixed at loins on back body cloth of slacks.

Next, an explanation of the second preferred embodiment of this invention follows.

Figure 8A:
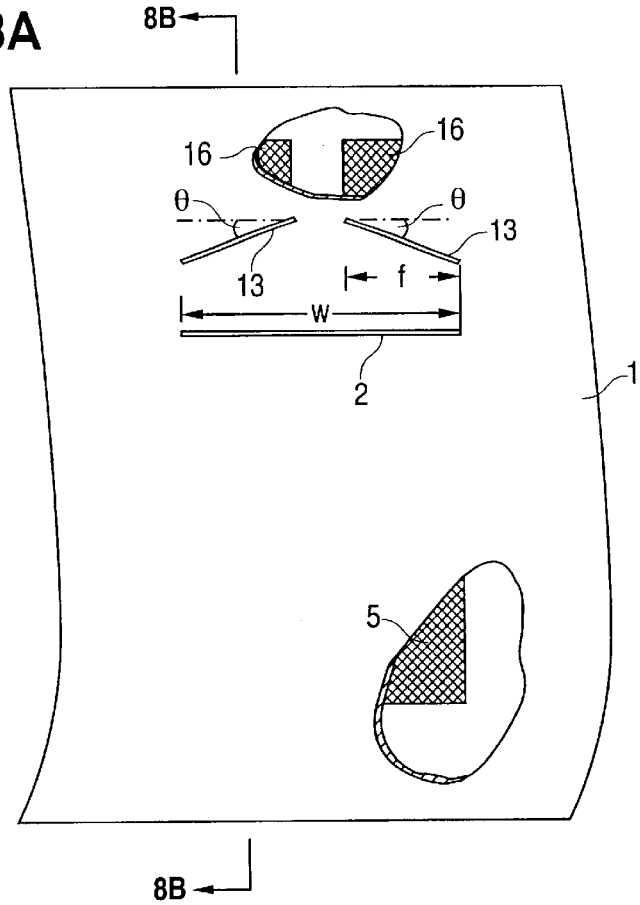
FIG. 8A is a partially cutaway front view.
Figure 8B:
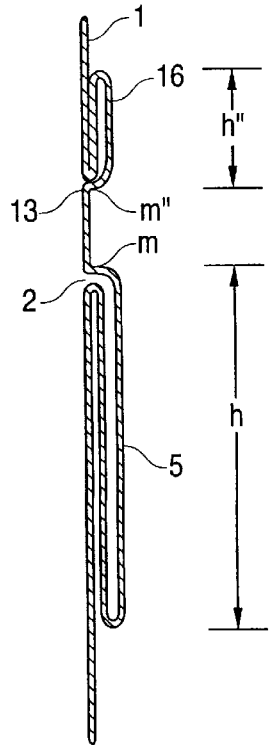
FIG. 8B is a sectional view taken along the line Y—Y of FIG. 8A.
Figure 9:
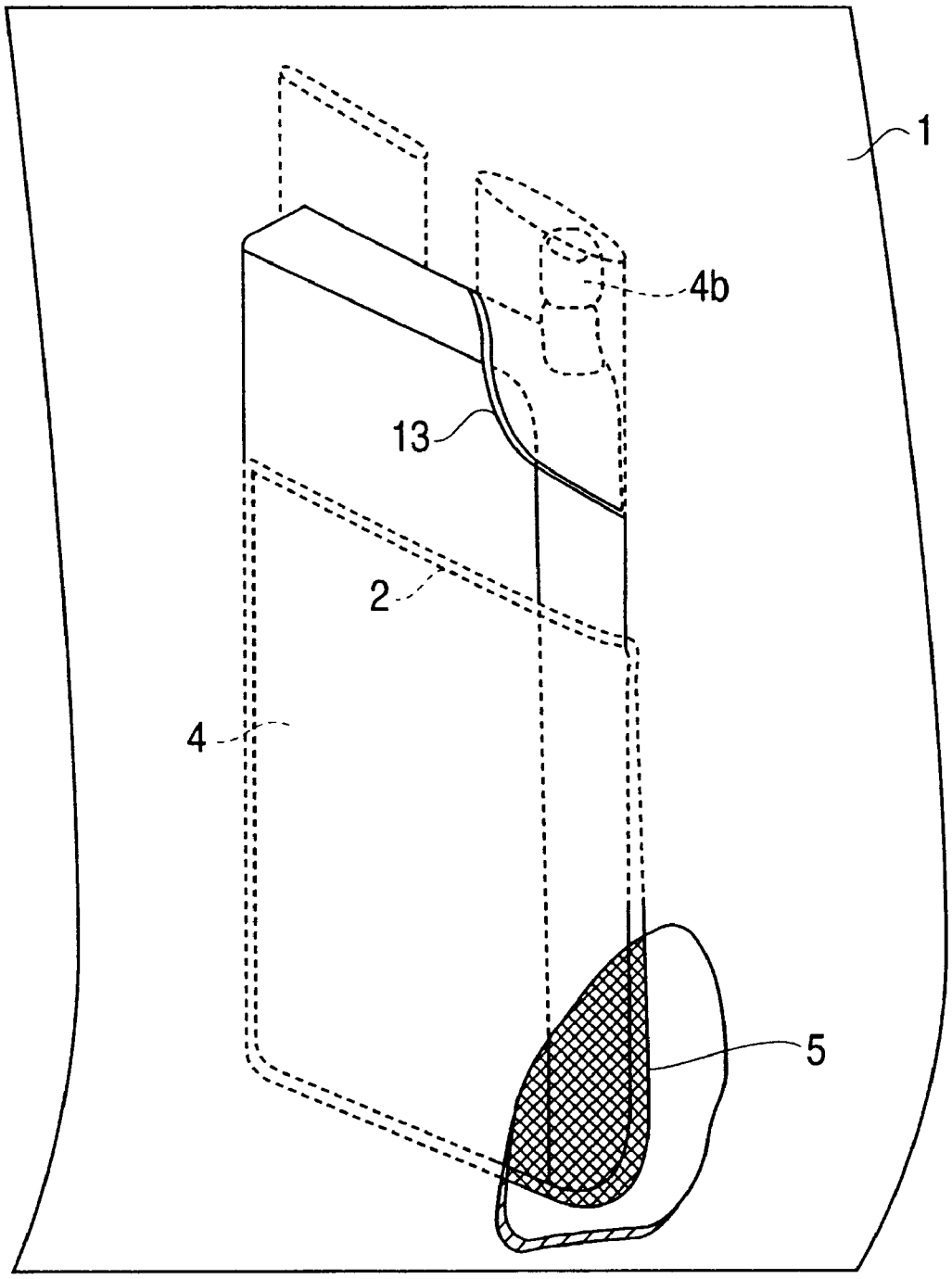
FIG. 9 shows how to use a pocket disclosed in FIG. 8.

FIG. 8 relates to the second embodiment, showing a modified example of the upper section 3 disclosed in the first embodiment. FIG. 8A is a partially cutaway front view, and FIG. 8B is a sectional view taken along the line Y—Y of FIG. 8A. FIG. 9 shows how to use the second embodiment. Here, the same marks are given to the same parts shown in the first embodiment.

In this embodiment as well, the lower section 2 is formed horizontally in cloth 1, and the bottom bag 5 is sewed to the lower section 2 so as to be suspended behind the cloth 1 as in the first embodiment.

On the other hand, at least one upper section 13 whose width (f) is comparatively small (within 2 cm~3 cm) is formed 2 cm to 4 cm above the right or left end of the lower section 2. Though in this figure the upper section 13 is formed to have a fixed inclination θ, it can be formed horizontally to the lower section 2. An antenna covering bag 16 is sewed (m") to each upper section 13 behind the cloth 1 as in the first embodiment. Here, the height (h") of the antenna covering bag 16 is within 1 cm~3 cm, so that an antenna 4*b* of the portable telephone 4 can be easily caught in the antenna covering bag 16, when being inserted therein.

If the above upper section 13 is provided to both sides, the portable telephone can be easily and conveniently inserted in the upper section 13 regardless of a location of the antenna 4*b* on the portable telephone 4. The inclination θ can be suitably changed. According to experiences of this inventor, however, it is most convenient to be within 15°~30°.

In this embodiment as well, the portable telephone 4 is inserted in or taken out of the pocket due to a stretchy effect of the bottom bag 5 as in the first embodiment. Since only the antenna 4*b* is caught in the antenna covering bag 16, the portable telephone 4 can be easily taken out by only pushing its upper part downward.

Figure 10:
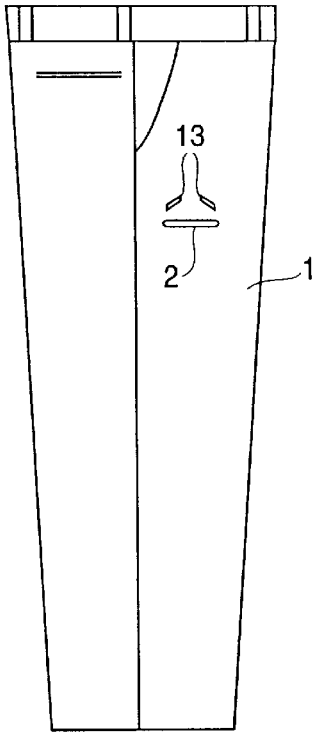
FIG. 10 and FIG. 11 show working examples of the pocket disclosed in FIG. 8.
Figure 11:
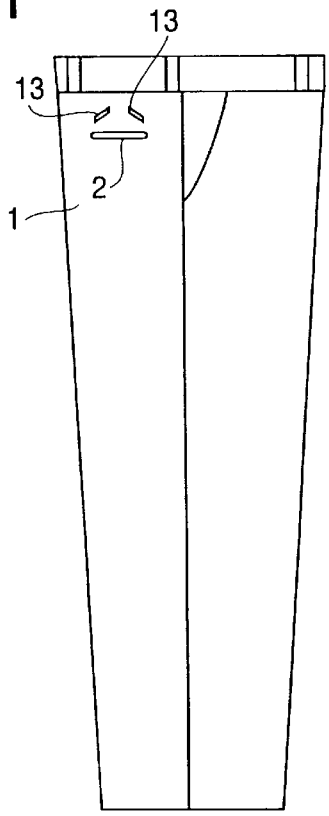

Working examples of this embodiment are same as in the first embodiment. That is, the pocket for portable telephone is formed in jacket cloth at the chest or upper arm, and in slacks cloth below both sides pockets or at loins. In this invention as well, the jacket is not limited to one, but any kind of jackets with long or short sleeves, which are worn in daily life, such as a working wear, shirt, or blouson. Slacks can be any kind such as a working wear, casual wear, or sport wear. As concrete examples, FIG. 10 shows the pocket provided below both sides pocket of slacks, and FIG. 11 shows the pocket provided at loins of slacks.

What is claimed is:

1. A pocket for a portable telephone with an antenna in clothes made of cloth having opposite sides, said pocket comprising:

a first opening in said cloth, said first opening having a width, and a right end and a left end;

a bottom bag made of stretchy material, said bottom bag having a depth that is shallow in comparison to the telephone, said bottom bag having an entrance portion defining a bag opening, said entrance portion of said bottom bag being secured to said cloth around said first opening in said cloth to be suspended along one of the sides of the cloth;

at least one second opening in said cloth, said at least one second opening being spaced from at least one of the right end and the left end of said first opening; and an antenna covering bag for covering the telephone antenna, said antenna covering bag having an entrance portion defining a bag opening, the entrance portion of the antenna covering bag being secured to said cloth around said second opening to stay along the same side of the cloth as the bottom bag.

2. A pocket for a portable telephone as set forth in claim 1, wherein said first opening comprises a slit.

3. A pocket for a portable telephone as set forth in claim 2, wherein said slit has a length of about 6 cm to about 9 cm.

4. A pocket for a portable telephone as set forth in claim 3, wherein a portion of said cloth extends between said first opening and said at least one second opening.

5. A pocket for a portable telephone as set forth in claim 1, wherein one of said opposite sides of said cloth is an interior side facing a wearer of the clothes, and said bottom bag and said antenna covering bag are positioned along said interior side of said cloth.

6. A pocket for a portable telephone as set forth in claim 1, wherein the entrance portion of the bottom bag is sewn around said first opening, and the entrance portion of the antenna covering bag is sewn around said at least one second opening.

7. A pocket for a portable telephone as set forth in claim 1, wherein the bottom bag has a depth of about 5 cm to about 10 cm.

8. A pocket for a portable telephone as set forth in claim 1, wherein said first opening is spaced about 2 cm to about 4 cm from said at least one second opening.

9. A pocket for a portable telephone as set forth in claim 1, wherein the antenna covering bag has a depth of about 1 cm to about 3 cm.

10. A pocket for a portable telephone as set forth in claim 1, wherein said at least one second opening comprises a slit.

11. A pocket for a portable telephone as set forth in claim 10, wherein the slit has a length of about 2 cm to about 3 cm.

12. A pocket for a portable telephone as set forth in claim 1, wherein said cloth is a front of a body of a jacket.

13. A pocket for a portable telephone as set forth in claim 1, wherein said cloth is a sleeve of a jacket.

14. A pocket for a portable telephone as set forth in claim 1, wherein said cloth is a front of a body of slacks.

15. A pocket for a portable telephone as set forth in claim 1, wherein said cloth is a back of a body of slacks.

* * * * *